United States Patent [19]

Tsuneda

[11] 4,259,428

[45] Mar. 31, 1981

[54] LIQUID DEVELOPER FOR ELECTROSTATIC LATENT IMAGE

[75] Inventor: Terukuni Tsuneda, Matsudo, Japan

[73] Assignee: Canon Kabushiki Kaisha, Tokyo, Japan

[21] Appl. No.: 114,462

[22] Filed: Jan. 23, 1980

Related U.S. Application Data

[63] Continuation of Ser. No. 887,306, Mar. 16, 1978.

[51] Int. Cl.[3] ..... G03G 9/12

[52] U.S. Cl. ..... 430/115; 430/138; 430/904

[58] Field of Search ..... 430/115, 138, 904

[56] References Cited

U.S. PATENT DOCUMENTS

| | | | |
|---|---|---|---|
| 2,907,674 | 10/1959 | Metcalfe et al. | 430/114 X |
| 3,032,432 | 5/1962 | Metcalfe et al. | 430/115 |
| 3,244,633 | 4/1966 | Yellin et al. | 430/115 |
| 3,576,744 | 4/1971 | Sharrock et al. | 430/114 |
| 3,834,930 | 9/1974 | Amidon et al. | 430/113 X |
| 3,839,032 | 10/1974 | Smith | 430/112 X |

FOREIGN PATENT DOCUMENTS

| | | |
|---|---|---|
| 252854 | 5/1963 | Australia . |

*Primary Examiner*—John D. Welsh

*Attorney, Agent, or Firm*—Fitzpatrick, Cella, Harper & Scinto

[57] ABSTRACT

A liquid developer for electrostatic latent images wherein a surface active agent and a terpene polymer are dispersed in a highly insulative carrier liquid together with a toner to encapsulate the toner particles with the polymer.

5 Claims, No Drawings

LIQUID DEVELOPER FOR ELECTROSTATIC LATENT IMAGE

This is a continuation of application Ser. No. 887,306, filed Mar. 16, 1978.

BACKGROUND OF THE INVENTION

1. Field of the Invention

This invention is concerned with an improved liquid developer for developing electrostatic latent images in electrostatic printing, electrophotography, and so forth.

2. Description of the Prior Art

Various liquid developers which have so far been used in developing electrostatic latent images are of such type that an additive like resin, etc. is dispersed in a highly insulative carrier liquid. The additive serves to control the content of a pigment and charged polarity of the pigment so as to facilitate dispersion of the pigment into the carrier liquid, and at the same time, serves to secure good fixation of a tone to a developed image.

Such a liquid developer for electrostatic latent images can be prepared by, as one example, mixing and kneading of a pigment such as carbon black with vegetable oils, resins, and so on, e.g., linseed oil, soybean oil, alkyd resin, polystyrene, acrylic resins, etc. as the polarity controlling agent, dispersing agent as well as fixing agent, followed by granulation of the kneaded mixture, and then by dispersing the particles into a highly insulative organic solvent such as hydrocarbons of the isoparaffin type.

Another known method of controlling the polarity of the toner in the liquid developer for electrostatic latent images other than coating the outer surface of the toner particles with vegetable oils, resins, etc. as mentioned above, includes dissolving a surface active agent in the carrier liquid so as to cause it to absorb onto the toner particles.

Many examples of the surface active agent to be used in the abovementioned second method are known, such as heavy metal soaps like cobalt naphthenate, manganese naphthenate, etc.; alkylbenzene sulfonic acid salts like dodecylbenzene calcium sulfonate, etc.; phospholipide (or phosphatides) as lecithin, cephalin, etc. These surface active agents, however, are not necessarily consistent in their resulting effect and manners of use. Moreover, as they are of low electric resistance, they inevitably lower the electric resistance of the carrier liquid when they are dissolved in such carrier liquid. In this consequence, the addition of such a surface active agent to the carrier liquid should be done to such an extent that it does not destroy the latent images formed on a photosensitive body at the time of the image development, on account of which the adding quantity of the surface active agent to the carrier liquid undergoes considerable restriction. In view of such restriction, the aforedescribed method is considered defective in that no sufficient amount of the surface active agent to give satisfactory electric charging quantity to the toner can be added to the carrier liquid.

With respect to liquid developers for use in color electrophotography, the conventional color electrophotographic method includes first imparting an electric charge to a photosensitive body having a photoconductive layer by corona discharge, thereafter resolving the original picture image into color components by means of color filters of red, blue, and green to thereby form an electrostatic latent image on the photosensitive body, and then immersing the electrostatic latent image in each of the developing liquids containing therein cyan, magenta, yellow, and black toners to develop and reproduce the color image.

In the above-described color process, the multi-colored image is formed on the same photosensitive body in succession. Then the latent image formed on the photosensitive body is developed and reproduced into the colored picture image like the original. If the photosensitive body having thereon the already toned image is immersed in another developing liquid for a different color, then the toner composition of resins, polarity controlling agent, etc. elute, or the toner itself can dissolve into the developing liquid to contaminate it also, at the time of superposing the developed images one by one, non-uniformity is trapping due to the light shielding effect of the prior toned image, and other disadvantages, tend to take place.

In obtaining a color reproduction image by transferring a colored picture image deposited on the photoconductive layer onto a transfer sheet one after another, the trouble caused by the light shielding effect of the toned picture image can be advantageously prevented. However, for the purpose of this color electrophotography, there has not been available an appropriate color toner, the fixation of which is suited for the transfer process, and, if such is used, no uniform transfer of the toner onto the transfer sheet can be attained to a required standard.

Further, known liquid developers for color electrophotography, the substance added for imparting to the pigment charge polarity, the dispersibility, and the fixing property is a vegetable oil such as linseed oil, soybean oil, etc., and a resin such as acrylic resin, rosin, etc. On account of this, when the pigment particles are coated with any of these coating materials, and dispersed in the carrier liquid, a large part of the coating agent coated on the pigment dissolves out into the carrier liquid and the residual quantity of the coating agent on the surface of the pigment becomes extremely small, with the consequence that the toner becomes less fixable to the recorded image, also, toner which has once adhered to the surface of the recorded image dissolves into the carrier liquid to contaminate the developing liquid. For this reason, the coating agent tends to separate gradually from the external surface of the pigment during repeated use of the developing agent or storage for long periods to thereby obscure the polarity of the toner, or the toner tends to become agglomerated and precipitated to make it impossible to reproduce the desired color.

Furthermore, in the case of a color reproduction, a desired color is reproduced by superimposing picture images of several color phases. If the resin coated on the toner particles separates therefrom for the above mentioned reason, the image loses its luster, and the depth of the colors of the image and the mixing property of the colored picture image are in no way sufficient. As a means to supplement this defect, it has been unavoidable to coat the surface of the developed image with a layer of a resinous material.

SUMMARY OF THE INVENTION

It is therefore an object of the present invention to provide an improved liquid developer for electrostatic latent images which has solved various defects inherent in conventional liquid developers as already pointed out.

It is another object of the present invention to provide a liquid developer for electrostatic latent images of a type in which the electric charging quantity of the toner is large, and the electric resistance of the carrier liquid does not decrease. Another object of the present invention is to provide a liquid developer for electrostatic latent images which is excellent in fixation and dispersibility of the toners, and in which the toner compositions dissolve out into the carrier liquid only in small amounts.

Another object of the present invention is to provide a liquid developer for electrostatic latent images which is capable of rendering good reproducibility in a colored picture image.

According to the present invention in one aspect thereof, there is provided a liquid developer which consists essentially of a highly insulative carrier liquid, a toner dispersed in the carrier liquid, a surface active agent, and a polymer of a terpene resin (or polyterpene resin) having a softening point of 50° C. and above, both being also uniformly dispersed in said carrier liquid.

Further, according to the present invention, in another aspect thereof, there is provided a liquid developer for electrostatic latent images of the above-recited nature, in which the toner is composed of a light transmitting thermoplastic resin having a softening point range of from 50° to 130° C. and being insoluble in both the carrier liquid and in coloring matters such as dyes and pigments.

The liquid developer preferably contains a terpene resin polymer having a softening point range of between 50° C. and 150° C.

The liquid developer preferably contains a surface active agent which is a phospholipid.

The liquid developer preferably contains a surface active agent which is an alkyl alanine containing an alkyl group having 8 to 20 carbon atoms.

The liquid developer preferably contains a surface active agent which is a heavy metal soap.

The liquid developer preferably contains a surface active agent which is a fatty acid zirconiums salt containing an alkyl group having 8 to 20 carbon atoms.

The liquid developer preferably contains a surface active agent which is an alkyl benzene sulfonate containing an alkyl group having 8 to 20 carbon atoms.

The liquid developer preferably contains a surface active agent which is a dialkyl sulfosuccinate containing an alkyl group having 8 to 20 carbon atoms.

The liquid developer preferably contains a surface active agent which is a dialkyl naphthalene sulfonate containing an alkyl group of 8 to 20 carbon atoms.

The liquid developer preferably contains a surface active agent which is polyoxyethylene sulfate.

The liquid developer preferably contains a surface active agent which is a dialkyl phosphate containing an alkyl group of 8 to 20 carbon atoms.

The liquid developer preferably contains a surface active agent which is a vegetable oil.

The liquid developer preferably contains a terpene resin polymer in the range of between 5 to 50% by weight with respect to the total weight of the toner.

The liquid developer contains the surface active agent in the range of between 1 mg and 10 g per liter of the developing liquid.

The light transmitting thermoplastic resin contained in the liquid developer is one or more kinds of polyvinyl chloride, polyvinylidene chloride, copolymers of vinyl chloride and vinylidene chlorinated polypropylene, copolymers of vinyl chloride and vinyl acetate, copolymers of vinyl chloride, vinyl acetate and maleic anhydride, ethyl cellulose, nitrocellulose, polyacrylic ester, linseed oil modified alkyd resin, rosin modified alkyd resin, phenol modified alkyd resin, phenolic resin, polyester resin, polyvinyl butyral, polyisocyanate, polyurethane, polyvinyl acetate, polyamide resin, cumarone resin, dammer resin, ketone resin, maleic acid resin, polystyrene, copolymers of styrene and butadiene, phenol modified pentaerythritol ester resin and colophonium.

The foregoing objects and details of the present invention will become more fully understandable from the following description thereof when read in conjunction with the preferred examples following the description.

DESCRIPTION OF THE PREFERRED EMBODIMENTS

The present invention, as has been stated, is to prepare the liquid developer for electrostatic latent images by dispersing particles of the toner in a highly insulative carrier liquid along with a small quantity of a surface active agent as an electric charge controlling agent, and a polymer of a terpene resin to remarkably promote the effect of the electric charge control.

The polymer of the terpene resin to be used in the present invention should preferably have a softening point of 50° C. and above (more specifically in a range of from 50° to 150° C.) and is synthesized in the following manner.

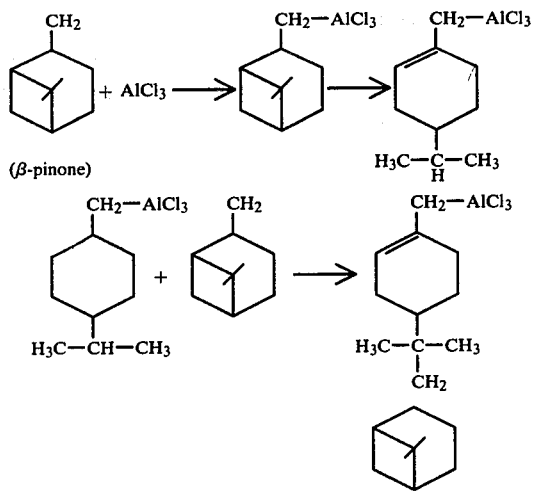

(Formula I)
(polymer of terpene)

By the above-described synthetic method, the terpene polymers of various softening points can be synthesized, of which the most preferable one for the purpose of the present invention possesses a softening point of 50° C. and above and is partially soluble in the carrier liquid.

The reason for selecting these terpene polymers of specific softening point range and solubility, though it still has to be clarified, is assumed to be that the part of the terpene polymer which has dissolved into the carrier liquid accelerates the dispersibility of the toner particles, whereas the remaining part of the terpene polymer which is difficult to dissolve tends to precipitate in the carrier liquid and covers the outer surface of the toner particles, while it is growing into resin particles of a fine size, and this covering of the toner particles by the fine particles of the terpene resin results in the surface active agent being adsorbed onto the outer surface of the polymer particles with the consequence that the outer surface of the toner particles becomes remarkably high in ion concentration, and the charged state of the toner particles is thus eminently promoted.

The above-described reactive phenomena are effective not only in the combination of pigment and surface active agent (where the toner consists of a pigment alone), but also in the combination of colored resin particles and surface active agent (where a pigment is dispersed in a resin which is insoluble in the carrier liquid). By making use of these reactive phenomena, it becomes possible to remarkably broaden the applicable range of the resins with respect to various pigments in the liquid developer. Another effect derived from the present invention is that since the surface active agent dissolved in the carrier liquid can be adsorbed on the outer surface of the toner particles at a high concentration, it can be removed readily at high efficiency together with the toner particles at the time of the image development.

On account of such remarkable effects of encapsulation of the toner particles with the terpene polymer and the surface active agent, there would accrue various advantages such that deterioration of the developing liquid due to accumulation of dissolved substances can be prevented, which makes it conveniently possible to recover the carrier liquid in the developer for re-use. Hence it is most suited for color electrophotographic development, wherein the carrier liquid is used repeatedly several times.

Further, the terpene polymer used in the liquid developer according to the present invention has exactly the same effect whether it is caused to cover the pigment particles or the colored resin particles insoluble in the carrier liquid from the carrier liquid phase, or it is first mixed with the pigment and resin, followed by dispersion in the carrier liquid. Very satisfactory liquid developer can be obtained in both methods of preparation.

The terpene polymers of Formula I having the softening point of 50° C. and above for use in the present invention, and available commercially are as follows:

| | | |
|---|---|---|
| YS Resin PX(*) | #500 | (50 ± 3° C.) |
| YS Resin PX(*) | #600 | (60 ± 3° C.) |
| YS Resin PX(*) | #700 | (70 ± 3° C.) |
| YS Resin PX(*) | #800 | (80 ± 3° C.) |
| YS Resin PX(*) | #900 | (90 ± 3° C.) |
| YS Resin PX(*) | #1000 | (100 ± 3° C.) |
| YS Resin PX(*) | #1150 | (115 ± 3° C.) |

(*)A trademark for the products of Yasuhara Yushi K. K., Japan

| | | |
|---|---|---|
| Piccolyte(*) | S - 55 | (55 ± 3° C.) |
| " | S - 70 | (70 ± 3° C.) |
| " | S - 85 | (85 ± 3° C.) |
| " | S - 100 | (100 ± 3° C.) |
| " | S - 115 | (115 ± 3° C.) |

-continued

| | | |
|---|---|---|
| " | S - 125 | (125 ± 3° C.) |
| " | S - 135 | (135 ± 3° C.) |

(*)A trademark for the products of Esso Standard Oil Co., U.S.A.

| | | |
|---|---|---|
| Wintack(*) | 95 | (95 ± 3° C.) |
| | 115 | (115 ± 3° C.) |

(*)A trademark for the products of Goodyear Tire Co., U.S.A.

The figures in the parentheses indicate the softening point. The adding quantity of these terpene polymer can be small for the effective encapsulation of the toner. In general, it can be 5 to 50% by weight, or, more preferably 10 to 20% by weight, with respect to the total weight of the toner.

The surface active agent and the polarity control agent to be used along with the terpene polymer for the purpose of the present invention are as follows.

Phospholipids such as lecithin, cephalin, etc.;

Alkyl alanines containing a long chain alkyl group of 8 to 20 carbon atoms;

Heavy metal soaps such as manganese naphthenate, cobalt naphthenate, aluminum naphthenate, nickel naphthenate, zinc naphthenate, iron naphthenate, etc.;

Zircouim salt of fatty acids having an alkyl group of 8 to 20 carbon atoms;

Alkylbenzene sulfo having an alkyl group of 8 to 20 carbon atoms (the salts are such as sodium, calcium, magnesium, potassium, aluminum, zinc, and barium);

Dialkyl sulfosccinates having an alkyl group of 8 to 20 carbon atoms (the salts are such as sodium, calcium, magnesium, potassium, aluminum, zinc, and barium);

Dialkyl naphthalene sulfonates having an alkyl group of 8 to 20 carbon atoms (the salts are such as sodium, calcium, magnesium, potassium, aluminum, zinc, and barium);

Polyoxyethylene sulfates having an alkyl group of 8 to 20 carbon atoms (the salts are such as sodium, calcium, magnesium, potassium, aluminum, zinc, and barium);

Dialkyl phosphates having an alkyl group of 8 to 20 carbon atoms (the salts are such as sodium, calcium, magnesium, potassium, aluminum, zinc, and barium);

Vegetable oils such as soybean oil, linseed oil, boiled linseed oil, chinese wood oil, tall oil, safflower oil, castor oil, poppy oil, peanut oil, etc.

The adding quantity of these surface active agents may be that amount which has been used in the conventional liquid developers, or less than that amount. In general, it can be used in the range of 1 mg to 10 g per liter of the developing liquid.

The pigments, resins, and carrier liquid, etc. other than the terpene polymer used in the present invention may be the same as those used in conventional liquid developers. For instance, the highly insulative carrier liquid to be used for the present invention may be one that possesses a volumetric resistance of $10^9$ ohm-cm and above, and a dielectricity of 3 and below. Preferred examples of such a carrier liquid are: n-heptane, di-pentene, iso-paraffin type hydrocarbons, kerosene, mineral spirits, tetralin, perchloro-ethylene, paraffin (lamp) oil, trichloro-trifluoroethane, and so forth.

The pigment for the toner composition may be usable if it is in a colored powder substance. Examples of such pigment are:

Mogul A
Elftex 5 } Trademarks for the products of

-continued

| | |
|---|---|
| Elfvulcan XC | Cabot Co., U.S.A. |
| Statex | (Trademark for a product of Columbia Carbon Co., U.S.A.) |
| Carbon Black XC - 550 | (Trademark for a product of Asahi Carbon K.K., JAPAN) |
| Carbon Black Mitsubishi #44<br>Carbon Black Mitsubishi #100 | (Trademarks for products of Mitsubishi Kasei Kogyo K.K.) |
| Benzidine Yellow GNN<br>Benzidine Orange Scarlet KR<br>Fast Red<br>Brilliant Carmine 6B<br>Sky Blue<br>Dianine Blue FG<br>Phthalocyanine Green LL | (Trademarks for the products of Sanyo Shikiso K.K., JAPAN) |
| Victoria Blue<br>Spyron Black<br>Spyron Orange<br>Spyron Red | (Trademarks for the products of Hodogaya Kagaku K.K., JAPAN) |
| Oil Blue<br>Vari Fast Blue<br>Spirit Black<br>Alkali Blue | (Trademarks for the products of Orient Kasei K.K., JAPAN) |
| Aniline Black | (Trademark for the product of ICI) |
| Cyanine Blue NSG<br>Fast Rose 836<br>Benzidine Yellow 471 | (Trademarks for the products of Dainichi Seika K.K., JAPAN) |

The resins to mainly impart fixability, dispersibility and transferability to the toner particles and to be used along with the above-listed coloring powder particles may be the same as those which have generally been used in conventional liquid developers.

In particular, however, light transmitting thermoplastic resins having a softening point range of from 50° to 130° C. and being insoluble in the carrier liquid are recommended for the liquid developer for color electrophotography. Preferred examples of such light transmitting thermoplastic resins are: vinyl chloride homopolymer, vinylidene chloride homopolymer, copolymers of vinyl chloride and vinylidene chloride, chlorinated polypropylene, copolymers of vinyl chloride and vinyl acetate, copolymers of vinyl chloride, vinyl acetate, and maleic anhydride, ethyl cellulose, nitro-cellulose, polyacrylic ester, linseed oil modified alkyd resin, rosin modified alkyd resin, phenol modified alkyd resin, phenolic resin, polyester resin, polyvinyl butyral, poly-isocyanate, polyurethane, polyvinyl acetate, polyamide resin, cumarone resin, dammar resin, cetone resin, maleic acid resin, polystyrene, copolymers of styrene and butadiene, copolymers of styrene, indene, and acrylonitrile, phenol modified pentaerythritol ester of rosin, and collophonium.

When any of the above enumerated light transmitting thermoplastic resins have a softening point range of from 50° C. to 130° C. insoluble in the carrier liquid is used, no elution and separation into the carrier liquid of the toner due to the major part of the toner composition being insoluble in the carrier liquid occurs, whereby the undesirable results of contamination of the developing liquid and deterioration in polarity and dispersibility of the toner can be prevented. Also, the softening points of the resins in the toner composition are low and do not reduce in quantity owing to elution, with the consequence that the toner exhibits good fixability, the toned image retains appropriate lustre, and the color-mixing of the colored picture image is also satisfactory, hence colored images of very high quality can be reproduced.

PREFERRED EXAMPLES

For the sake of enabling persons skilled in the art to reduce the present invention into practice, the following preferred examples are presented. It should however be noted that these examples are illustrative only, and changes in the ingredients and their contents may be made within the ambit of the present invention as set forth in the appended claims.

(A) LIQUID DEVELOPER FOR MONOCHROMATIC ELECTROPHOTOGRAPHY

Example 1

A mixture of the following components was kneaded by a double roll mill for one hour to sufficiently disperse the pigment in the whole mixture.

- Helio Fast Pink E C. L. No. 60745 (Trademark for a product of Bayer) 34 g
- XPL 2005 (Trademark for a polyester resin of Kao-Atlas Co.) 75 g
- Solprene 1205 (Trademark for sbyrenebutadiene copolymer of Asahi Kasei Kogyo K.K.) 15 g 27 g of the above mixture was further kneaded for 40 hours in a ball mill together with 60 mg of Isopar H (Trademark for isoparaffin type hydrocarbon of Esso Standard Oil Co, and a solution of 4 g of YS Resin PX #900 (Trademark for terpene polymer of Yasuhara Yushi K.K.) in 5 ml of Solvesso 100 (a trademark for aromatic hydrocarbon of Esso Standard Oil Co.) to prepare a concentrated toner liquid A.

An other concentrated toner liquid B was prepared in the same manner as liquid A except that concentrated toner liquid B does not contain YS Resin PS #900 liquid.

In the meantime, a dispersion liquid consisting of 100 g of finely crystallized cadmium sulfide, 10 g of solution of a copolymer of vinyl chloride and vinyl acetate in soluene of 50% conc., and 80 g of toluene was applied onto an aluminum foil of 0.05 mm in thickness in such a manner that the final thickness of the coating layer after drying was 40 microns. Over this coating, there was adhered a polyester film of 38 microns thickness by an epoxy resin adhesive agent of a normal temperature setting type, thereby producing a photosensitive body of a three-layer structure.

This photosensitive body was subjected to a corona charging at a positive corona voltage of 7,000 volts and subsequently to an a.c. corona charging at 7,000 volts simultaneously with an imagewise exposure, after which the entire surface of the photosensitive body was uniformly exposed to form an electrostatic latent image. The latent image was developed with developing liquids A' and B' obtained by dispersing 30 ml of each of the abovementioned concentrated toner liquids A and B into 1,000 ml of Isopar H (a trademark for an isoparaffin type hydrocarbon of Esso Standard Oil Co.) containing therein 20 mg of lecithin as an electric charge controlling agent, whereby respective positive images were obtained. A transfer sheet was closely contacted to each of the developed positive images, and electric charge was imparted to the transfer sheet from its back surface at a positive voltage of 6,000 volts, followed by peeling the transfer sheet off the surface of the positive image, whereupon the developed image is transferred onto the sheet.

The quantities of the developed images due to both developing liquid A' and B' are as shown in the following comparative table.

TABLE 1

| Developing Liquid | Image Density ($D_{max}$)* | Image Quality |
|---|---|---|
| A' (containing terpene polymer) | 1.1 | Good |
| B' (not containing terpene polymer) | 0.4 | Partial non-uniformity in solid black area |

*Dmax is a value measured by a densitometer.

Example 2

Liquid developers were prepared in the same manner as in Example 1 except that the terpene resins listed below were employed in place of YS Resin PX #900.

The development of the electrostatic latent image produced on the photosensitive body was carried out in the same manner as in the previous example, and the results shown in the following table were obtained.

TABLE 2

| Terpene Polymer | Image Density (D max) |
|---|---|
| YS Resin PX #500 | 0.9 |
| YS Resin PX #600 | 0.92 |
| YS Resin PX #700 | 1.05 |
| YS Resin PX #800 | 1.02 |
| YS Resin PX #1000 | 1.08 |
| Piccolyte S - 115 | 1.05 |
| Piccolyte S - 100 | 1.07 |

Example 3

A mixture of the following components was kneaded for 30 minutes by a double roll mill to sufficiently disperse the pigment in the whole mixture.

| | |
|---|---|
| Carbon Black | 20g |
| XPL 2005 (a trade name for a polyester resin of Kao-Atlas Co.) | 75g |
| Solprene 1205 (a trademark for a copolymer of styrene and butadiene of Asahi Kasei Kogyo K.K.) | 15g |

After the kneading, 27 g of the above-mentioned kneaded mixture and 4 g of Piccolyte S-100 (a trademark for a terpene polymer of Esso Standard Oil Co.) dispersed in 60 ml of Isopar H were further kneaded in a roll mill for 40 hours to prepare a concentrated toner liquid. 30 ml of this concentrated toner liquid and 30 mg of cobalt naphthenate were dispersed in 1,000 ml of isopar H to prepare a developing liquid C.

Further, another concentrated toner liquid was prepared in the same manner but without the terpene resin Piccolyte S-100. 30 ml of this concentrated toner liquid and 30 mg of cobalt naphthenate were dispersed in 1,000 ml of Isopar H to obtain a developing liquid D.

On the other hand, 100 g of finely crystallized zinc oxide, 20 g of a copolymer of styrene and butadiene in a 50% toluene solution, 40 g of normal butylmethacrylate in a 50% toluene solution, 120 g of toluene, and 4 ml of rose bengal in a 17% methanol solution were mixed and well dispersed in a ball mill for 6 hours. The mixture was applied onto the surface of a sheet of paper which had previously been subjected to an undercoating treatment in such a manner that the final thickness of the coated layer after drying was 20 microns, whereby a photosensitive paper for electrophotography was produced.

Then, a corona charging was conducted on this electrophotographic sensitive paper at a negative corona voltage of −6,000 volts. Subsequently, an image was irradiated on this charged photosensitive paper which had been magnified from a negative micro-photographic film to form an electrostatic latent image. The latent image was then immersed in each of the above-mentioned developing liquids C and D to obtain black, positive picture images with the results as shown in the following Table 3.

TABLE 3

| Developing Liquid | Image Density (D max) | Image Quality |
|---|---|---|
| C | 1.0 | Good |
| D | 0.4 | Poor |

Example 4

Instead of cobalt naphthenate used in Example 3, the below-listed heavy metal soaps were used. The results of the same coparative experiments same as in the foregoing examples are as shown in Table 4 below.

TABLE 4

| Heavy Metal Soap | Image Density: Containing Piccolyte S 100 | Image Density: Not Containing Piccolyte S-100 |
|---|---|---|
| Manganese Naphthenate | 1.1 | 0.35 |
| Aluminum Naphthenate | 1.0 | 0.4 |
| Lead Naphthenate | 0.9 | 0.41 |
| Zinc Naphthenate | 0.9 | 0.38 |
| Iron Naphthenate | 0.8 | 0.42 |
| Nickel Naphthenate | 1.0 | 0.40 |

Example 5

In place of lecithin used in Example 1 above, the below listed vegetable oils were used. The results the same of comparative experiments in the foregoing examples are as shown in the following Table 5.

TABLE 5

| Vegetable Oil | Image Concentration: Containing YS Resin PX #900 | Image Concentration: Not Containing YS Resin PX #900 |
|---|---|---|
| Soybean Oil | 1.0 | 0.35 |
| Linseed Oil | 0.9 | 0.35 |
| Boiled Linseed Oil | 0.9 | 0.38 |
| China Wood Oil | 1.0 | 0.40 |
| Tall Oil | 1.0 | 0.35 |
| Safflower Oil | 1.1 | 0.38 |
| Castor Oil | 0.9 | 0.37 |
| Poppy Oil | 0.95 | 0.40 |
| Peanut Oil | 0.98 | 0.41 |

Example 6

In place of lecithin used in Example 1, various salts of dioctyl sulfosuccinic acid as listed below were used and the results as shown in Table 6 were obtained.

TABLE 6

| Salt | Image Density: Containing Terpene Polymer | Image Density: Not Containing Terpene Polymer |
|---|---|---|
| Sodium (Na) | 0.95 | 0.40 |
| Potassium (K) | 1.0 | 0.40 |
| Magnesium (Mg) | 0.9 | 0.38 |
| Aluminium (Al) | 0.8 | 0.38 |
| Zinc (Zn) | 0.7 | 0.38 |
| Barium (Ba) | 0.9 | 0.40 |
| Calcium (Ca) | 1.0 | 0.40 |

Example 7

Instead of cobalt naphthenate used in Example 3, zirconium octate, or calcium polyoxyethylene octadecyl sulfonate was used, and substantially the same results were obtained.

Example 8

Using the same procedure as in Example 1, cephaline (phospholipid) was used in place of lecithin, and comparative experiments were conducted in a similar manner. The results are substantially the same as in Example 1.

Example 9

Using the same procedure as in Example 1, various salts of dinonyl naphthalene sulfonic acid as listed below were used in place of lecithin, and the results are shown in Table 7 below were obtained.

TABLE 7

| Salt | Image Density: Containing Terpene Polymer | Image Density: Not Containing Terpene Polymer |
|---|---|---|
| Sodium (Na) | 1.1 | 0.39 |
| Potassium (K) | 1.1 | 0.41 |
| Magnesium (Mg) | 1.0 | 0.35 |
| Aluminium (Al) | 1.0 | 0.38 |
| Zinc (Zn) | 0.9 | 0.40 |
| Barium (Ba) | 1.0 | 0.39 |
| Calcium (Ca) | 1.2 | 0.4 |

Example 10

Following the procedure of Example 1 above, various salts of dodecylbenzene sulfonic acid as listed below were used in place of lecithin. The results of the comparative experiments conducted in the same manner as in the foregoing examples are as shown in the following Table 8.

TABLE 8

| Salt | Image Density: Containing Terpene Polymer | Image Density: Not Containing Terpene Polymer |
|---|---|---|
| Sodium (Na) | 1.1 | 0.4 |
| Potassium (K) | 1.2 | 0.4 |
| Magnesium (Mg) | 1.0 | 0.41 |
| Aluminum (Al) | 1.1 | 0.39 |
| Zinc (Zn) | 0.95 | 0.40 |
| Barium (Ba) | 1.0 | 0.35 |
| Calcium (Ca) | 1.2 | 0.4 |

Example 11

In place of lecithin used in Example 1, octadecyl alanine or tetradecyl alanine was used to prepare the developing liquid in exactly the same manner. The results obtained were found to be substantially the same.

Example 12

In place of the dioctyl calcium sulfosuccinate used in Example 6, ditetradecyl calcium sulfosuccinate or dioctadecyl calcium sulfosuccinate was used to prepare the developing liquid in exactly the same manner as in Example 1. The results obtained were substantially the same.

Example 13

In place of the dinonylnaphthalene calcium sulfonate used in Example 9, ditetradecyl naphthalene calcium sulfonate or dioctadecyl naphthalene calcium sulfonate was used to prepare the developing liquid in exactly the same manner as in Example 1. The results obtained were substantially the same.

Example 14

The developing liquids as in Example 1 were prepared by using octylbenzene calcium sulfonate or octadecylbenzene calcium sulfonate in place of dodecylbenzene calcium sulfonate used in Example 10, and substantially the same results were obtained.

Example 15

The developing liquids as in Example 1 were prepared by using polyoxyethylene octadecylbenzene calcium sulfonate or polyoxyethylene tetradecylbenzene calcium sulfonate in place of dioctyl calcium sulfosuccinate used in Example 6, and substantially the same results were obtained.

Example 16

The developing liquid as in Example 1 were prepared by using dioctyl calcium phosphate, ditetradecyl calcium phosphate, and dioctadecyl calcium phosphate, respectively, in place of dioctyl calcium sulfosuccinate, and substantially the same results were obtained.

Example 17

As in Example 3, a concentrated toner liquid was prepared using Piccoflex 520 (a trademark for a copolymer of styrene, indene, and acrylonitrile of Pennsylvania Industrial Chemical Corporation) and Piccolyte S-135 (a trademark for a terpene polymer of Esso Standard Oil Co.) in place of XPL 2005 and Piccolyte S-100, respectively. Substantially the same results were obtained.

(B) LIQUID DEVELOPER FOR COLOR ELECTROPHOTOGRAPHY

Example 18

1. (Recipe for Magenta Color Toner)

A mixture of the following components was kneaded for one hour by a double-roll mill to sufficiently disperse the pigment.

| | |
|---|---|
| New Fast Pink C.I. No. 45160 (a trademark for a red color pigment of Daido Kasei K.K.) | 41g |
| Seika Light Rose R - 40 (a trademark for a red color pigment of Dainichi Seika K.K.) | 20g |
| Piccoflex 105 (a trademark for a copolymer of styrene, indene, and acrylonitrile of Pennsylvania Industrial | |

-continued

| | |
|---|---|
| Chemical Corporation) | 33g |
| XPL 2005 (a trademark for a polyester resin of Kao-Atlas Co.) | 150g |

Thereafter, the mixture was placed in a ball mill and subjected to milling operation for 5 hours together with Isopar H (a trademark for an isoparaffinic type hydrocarbon of Esso Standard Oil Co.) so as to be crushed into coarse particles. After absorption and filtration of the dispersed material, it was washed with isopar H and desiccated to obtain red pigment powder.

30 g of this red pigment powder, 4 g of YS Resin PX #900 (a trademark for a terpene polymer of Yasuhara Yushi K.K.), and 3 g of Solprene 1205 (a trademark for a copolymer of styrene and butadiene of Asahi Kasei K.K.) were dissolved in 7 g of Solvesso 100 (a trademark for an aromatic hydrocarbon solvent of Esso Standard Oil Co.). The solution was put in a ball mill together with 60 ml of Isopar H and subjected to the milling operation for 40 hours, whereby a concentrated toner liquid containing the disperse toner having an average particle size of 1 micron was obtained. Subsequently, 30 ml of this concentrated toner liquid and 20 mg of lecithin (a product of Junsei Kagaku K.K.) were uniformly dispersed in 1000 ml of Isopar H to prepare a developing liquid.

2. (Recipe for Cyan Color Toner)

In the same manner as in the case of preparing the abovementioned magenta color toner, a mixture of the following ingredients was kneaded in a double-roll mill to obtain the developing liquid containing therein the toner particles having an average diameter of 1 micron.

| | |
|---|---|
| Seika Light Blue Conc. (a trademark for a blue color pigment of Dainichi Seika K.K.) | 100g |
| Piccoflex 105 (a trademark for a copolymer of styrene, indene, and acrylonitrile of Pennsylvania Industrial Chemical Corporation) | 33g |
| XPL 2005 (a trademark for a polyester resin of Kao-Atlas Co.) | 150g |

3. (Recipe for Yellow Color Toner)

As in the case with the magenta color toner mentioned above, a mixture of the following ingredients were kneaded by a double-roll mill to prepare the developing liquid containing therein the toner particles having an average diameter of 1 micron.

| | |
|---|---|
| Seika Fast Yellow 7045 C.I. No. 21090 (a trademark for a yellow color pigment of Dainichi Seika K.K.) | 34g |
| Piccoflex 105 (a trademark for a copolymer of styrene, indene, and acrylonitrile of Pennsylvania Industrial Chemical Corporation) | 33g |
| XPL 2005 (a trademark for a polyester resin of Kao-Atlas Co.) | 150g |

4. (Recipe for Black Color Toner)

As in the case with the magenta color toner mentioned in the foregoing, a mixture of the following ingredients was kneaded by a double-roll mill to prepare the developing liquid containing therein the toner particles having an average diameter of 1 micron.

| | |
|---|---|
| Carbon Black | 30g |
| Piccoflex 105 (a trademark for a copolymer of styrene, indene, and acrylonitrile of Pennsylvania Industrial Chemical Corporation) | 33g |
| XPL 2005 (a trademark for a polyester resin of Kao-Atlas Co.) | 100g |

5. (Recipe for Comparative Magenta Color Toner)

For the purpose of comparison with the foregoing recipe for the magenta color toner 1, a mixture of the following ingredients was uniformly dispersed for 3 hours in an attritor.

| | |
|---|---|
| New Fast Pink (a trademark for a pigment of Daido Kasei K.K.) | 41g |
| Seika Light Rose R - 40 C.I. No. 45160 (a trademark for a pigment of Dainichi Seika K.K.) | 20g |
| Beckosol P 450 (a trademark for a rosin modified alkyd resin of Nippon-Reichhold K.K.) | 25g |
| Solprene 1205 (trademark for a copolymer of styrene and butadiene of Asahi Kasei K.K.) | 15g |
| Chlorinated Paraffin | 50g |

Each of Beckosol P 450, Solprene 1205, and chlorinated Paraffin used for this purpose was dissolved in Solvesso 100 (a trademark for an aromatic hydrocarbon solvent of Esso Standard Oil Co.) in a concentration of 40% by weight.

After the dispersing operation, 1,000 ml of Isopar H was added to the resulting mixture, and further dispersion was conducted for 30 minutes to obtain a concentrated toner liquid. Thereafter, 40 ml of the concentrated toner liquid andd 20 mg of lecithin were dispersed in 1,000 ml of Isopar H to prepare the developing liquid.

6. (Recipe for Comparative Cyan Color Toner)

For the purpose of comparison with the foregoing recipe for the cyan color toner 2, a mixture of the following ingredients was treated in a same manner as set forth in the abovementioned comparative magenta color toner to obtain the developing liquid.

| | |
|---|---|
| Seika Light Blue Conc. (a trademark for a blue color pigment of Dainichi Seika K.K.) | 100g |
| Beckosol P 450 (a trademark for a rosin modified alkyd resin of Nippon-Reichhold K.K.) | 25g |
| Solprene 1205 (a trademark for a copolymer of styrene and butadiene of Asahi Kasei K.K.) | 15g |
| Chlorinated Paraffin | 50g |

7. (Recipe for Comparative Yellow Color Toner)

For the purpose of comparison with the foregoing recipe for the yellow color toner 3, a mixture of the following ingredients was treated in the same manner as set forth in the aforementioned comparative megenta color toner, thereby obtaining a developing liquid.

| | |
|---|---|
| Seika Fast Yellow 7045 (a trademark for a yellow | 34g |

-continued

| | |
|---|---|
| color pigment of Dainichi Seika K.K.) | |
| Beckosol P 450 (a trademark for a rosin modified alkyd resin of Nippon-Reichhold K.K.) | 25g |
| Solprene 1250 (a trademark for a copolymer of styrene and butadiene of Asahi Kasei K.K.) | 15g |
| Chlorinated Paraffin | 50g |

8. (Recipe for Comparative Black Color Toner)

For the purpose of comparison with the foregoing recipe for the black color toner 4, a mixture of the following ingredients was treated in the same manner as set forth in the aforementioned comparative magenta color toner, thereby obtaining a developing liquid.

| | |
|---|---|
| Carbon Black | 30g |
| Beckosol P 450 (a trademark for a rosin modified alkyd resin of Nippon-Reichhold K.K.) | 25g |
| Solprene 1250 (a trademark for a copolymer of styrene and butadiene of Asahi Kasei K.K.) | 15g |
| Chlorinated Paraffin | 50g |

9. (Formation and Development of Electrostatic Latent Image).

Onto the surface of an aluminum foil of 0.05 mm thickness a dispersed liquid consisting of 100 g of finely crystallized cadmium sulfide, 10 g of a 50% toluene solution of a copolymer of vinyl chloride and vinyl acetate, and 80 g of toluene was applied in such a manner that the final thickness of the coated layer was 40 microns, and then the applied coating was subjected to drying. Over this coated layer, a polyester film of 38 microns thickness was adhered by an epoxy resin adhesive agent of a normal temperature setting type, whereby a photosensitive body of a three-layer structure was produced.

The photosensitive body was then wound around a cylindrical drum, and subjected to a corona charging at a positive corona voltage of 7,000 volts. Subsequently, an insulative filter is interposed between an original color picture image and the photosensitive body for the image exposure with simultaneous a.c. corona charging at a charging voltage of 7,000 volts. Thereafter, the entire surface of the photosensitive body was uniformly exposed to form a latent image. Next, by using red and blue filters, other latent images were formed on the cylindrical drum in the same manner as described above. Finally, without using the red, blue, and green filters, the intensity of the exposure light was gradually made excessive, thereby extinguishing the latent image of the original color picture image to a substantial degree and forming the electrostatic latent image consisting of the blackened part alone.

The portion of the latent image formed by electric charging and exposure light by interposition of the green filter between the color original and the photosensitive body was developed with the developing agent containing the magenta color toner. In like manner, the latent image portion obtained through the blue filter was developed with the developing agent containing the yellow color toner, the latent image portion obtained through the red filter was developed with the a developing agent containing the cyan color toner, and the latent image portion consisting of only the black image portion which has been derived from extinction of the latent image of the color picture images with an excessive exposure light without using the colored filters was developed with a developing agent containing the black toner. These developed images were transferred one by one to the transfer sheet by imparting an electric voltage thereon, whereby a color reproduction image which has reproduced the color original with high fidelity could be obtained.

The reproduced picture image was completely fixed on the transfer sheet by thermal fixation. The resulting color picture image was excellent in its color mixing and of extremely high image quality having good luster.

For the sake of comparison a, colored picture image was reproduced by developing the latent images formed in the same manner as mentioned above with the comparative color developers. These colored picture images, however, were found to have been insufficient for their fixation and transferability, and the image surface was also poor in gloss and the color mixing in the transferred image was also inferior.

EXAMPLE 19

1. (Recipe for Magenta Color Toner)

A mixture of the following components was treated in the same manner as in the case of preparing the magenta color toner in the preceding Example 18, and the developing liquid containing therein the toner particles having an average diameter of 1 micron was prepared by using cobalt naphthenate in place of lecithin as used in Example 1.

| | |
|---|---|
| Seika Fast Carmine 6 B 1480 C.I. No. 15850 (a trademark for a red color pigment of Dainichi Seika K.K.) | 41g |
| Seika Light Rose R - 40 C.I. No. 45760 (a trademark for a red colored pigment of Dainichi Seika K.K.) | 20g |
| Piccoflex 100 resin (a trademark for a copolymer of styrene, indene, and acrylonitrile of Pennsylvania Industrial Chemical Corp.) | 33g |
| Piccolastics D - 75 (a trademark for a polystyrene of Esso Standard Oil Co.) | 116g |

2. (Recipe for Cyan Color Toner)

A mixture of the following components was treated in the same manner as in the case of preparing the cyan color toner in the preceding Example 18, and a developing liquid containing therein the toner particles having an average diameter of 1 micron was prepared by using cobalt naphthenate in place of lecithin as used in Example 1.

| | |
|---|---|
| Seika Light Blue A 612 C.I. No. 74200 (a trademark for a blue color pigment of Dainichi Seika K.K.) | 100g |
| Cromo Phtal Blue 4 G (a trademark for a blue color pigment of Ciba & Cie.) | 20g |
| Piccoflex 100 resin (a trademark for a copolymer of styrene, indene, and acrylonitrile of Pennsylvania Industrial Chemical Corp.) | 33g |
| Piccolastics D - 75 (a trademark for a polystyrene of Esso Standrd Oil Co.) | 116g |

3. (Recipe for Yellow Color Toner)

A mixture consisting of the following components was treated in the same manner as in the case of preparing the yellow color toner in the preceding Example 18, and a developing liquid containing therein the toner particles having an average diameter of 1 micron was prepared by using cobalt naphthenate in place of lecithin as used in Example 1.

| | |
|---|---|
| Cromo Phtal Yellow (a trademark for a yellow pigment of Ciba & Cie.) | 4g |
| Piccoflex 100 resin (a trademark for a copolymer of styrene, indene, and acrylonitrile of Pennsylvania Industrial Chemical Corp.) | 33g |
| Piccolastics D - 75 (a trademark for a polystyrene of Esso Standard Oil Co.) | 150g |

4. (Recipe for Black Color Toner)

A mixture consisting of the following components was treated in the same manner as in the case of preparing the yellow color toner in the preceding Example 18, and a developing liquid containing therein the toner particles having an average diameter of 1 micron was prepared by using cobalt naphthenate in place of lecithin as used in Example 1.

| | |
|---|---|
| Carbon Black | 30g |
| Piccoflex 100 resin (a trademark for a copolymer of styrene, indene, and acrylonitrile of Pennsylvania Industrial Chemical Corp.) | 33g |
| Piccolastics D - 75 (a trademark for a polystyrene of Esso Standard Oil Co.) | 150g |

5. (Recipe for Comparative Magenta Color Toner)

For the purpose of comparison with the foregoing recipe for the magenta color toner 1, a mixture of the following ingredients was uniformly dispersed for 3 hours in an attritor.

| | |
|---|---|
| Seika Fast Carmine 6 B 1480 C.I. No. 158572 (a trademark for a red color pigment of Dainichi Seika K.K.) | 41g |
| Seika Light Rose R - 40 C.I. No. 45160 (a trademark for a red colored pigment of Dainichi Seika K.K.) | 20g |
| Beckosol P 450 (a trademark for a rosin modified alkyd resin of Nippon-Reichhold K.K.) - in 40% solution of Solvesso 100 | 25g |
| Solprene 1205 (a trademark for a copolymer of styrene and butadiene of Asahi Kasei K.K.) - in 40% solution of Solvesso 100 | 15g |
| Chlorinated Paraffin - in 40% solution of Solvesso 100 | 50g |

After the dispersing operation, 1,000 ml of Isopar H was added to the resulting mixture, and further dispersion was conducted for 30 minutes to obtain a concentrated toner liquid. Thereafter, 40 ml of the concentrated liquid toner liquid and 20 mg of cobalt naphthenate were dispersed in 1,000 ml of Isopar H, whereby a developing liquid was prepared.

6. (Recipe for Comparative Cyan Color Toner)

For the purpose of comparison with the foregoing recipe for the cyan color toner 2, a mixture of the following ingredients was treated in the same manner as set forth in the abovementioned comparative magenta color toner, and a developing liquid was thereby obtained.

| | |
|---|---|
| Seika Light Blue A 612 C.I. No. 74200 (a trademark for a blue color pigment of Dainichi Seika K.K.) | 100g |
| Cromo Phtal Blue 4G (a trademark for a blue color pigment of Ciba & Cie.) | 20g |
| Beckosol P 450 (a trademark for a rosin modified alkyd resin of Nippon-Reichhold K.K.) in 40% solution of Solvesso 100 | 25g |
| Solprene 1250 (a trademark for a copolymer of styrene and butadiene of Asahi Kasei K.K.) in 40% solution of Solvesso 100 | 15g |
| Chlorinated Paraffin - in 40% solution of Solvesso 100 | 50g |

7. (Recipe for Comparative Yellow Color Toner)

For the purpose of comparison with the foregoing recipe for the yellow color toner 3, a mixture of the following ingredients was treated in the same manner as set forth in the abovementioned comparative magenta color toner, and a developing liquid was thereby obtained.

| | |
|---|---|
| Cromo Phtal Yellow (a trademark for a yellow pigment of Ciba & Cie.) | 34g |
| Beckosol P 450 (a trademark for a rosin modified alkyd resin of Nippon-Reichhold K.K.) - in 40% solution of Solvesso 100 | 25g |
| Solprene 1205 (a trademark for a copolymer of styrene and butadiene of Asahi Kasei K.K.) - in 40% solution of Solvesso 100 | 15g |
| Chlorinated Paraffin - in 40% solution of Solvesso 100 | 50g |

8. (Recipe for Comparative Black Color Toner)

For the purpose of comparison with the foregoing recipe for the black color toner 4, a mixture of the following ingredients was treated in the same manner as set forth in the abovementioned comparative magenta color toner, and a developing liquid was thereby obtained.

| | |
|---|---|
| Carbon Black | 30g |
| Beckosol P 450 (a trademark for a rosin modified alkyd resin of Nippon-Reichhold K.K.) - in 40% solution of Solvesso 100 | 25g |
| Solprene 1205 (a trademark for a copolymer of styrene and butadiene of Asahi Kasei K.K.) - in 40% solution of Solvesso 100 | 15g |
| Chlorinated Paraffin - in 40% solution of Solvesso 100 | 50g |

9. (Formation and Development of Electrostatic Latent Image)

Onto a sheet of electrophotographic reproduction paper available in the general market (reproduction paper, on which a photoconductive layer is formed by adhering zinc oxide on a base paper with a resin binder), there is imparted a negative electrostatic charge. Subsequently, exposure of an original color picture was done on the reproduction paper by interpasing red, green, and green filters between the colored original and the reproduction paper.

The exposed paper was then treated by using the aforementioned color liquid developers for electrophotography of magenta, cyan, yellow, and black colors. That is to say, the exposed reproduction paper was immersed in the developing agent containing the black color toner to develop the black image portion. Then, an electrostatic charge was impressed on the reproduction paper, on which the black image portion is developed. Subsequently, another exposure was done by interposing the red filter between the colored original and the reproduction paper, followed by immersion thereof into the developing agent containing the cyan color toner, whereby a cyan colored image portion was developed. After further impression of the electrostatic charge onto the reproduction paper, further exposure was conducted through the green filter interposed between the colored original and the reproduction paper, followed by immersion of the exposed paper into the developing agent containing the magenta color toner to develop a magenta color image portion. Next, other exposure was conducted on the reproduction paper through the blue filter in the same manner as in the previous exposures, followed by immersion of the exposed paper into the developing agent containing the yellow color toner to develop a yellow colored image portion. By repeating the exposure-development processes through the different color filters and the developing agents containing different color toners, a very clear color reproduction of the original picture image could be obtained with high fidelity.

The reproduced picture image was completely fixed on the transfer sheet by thermal fixation. The resulting color picture image was excellent in its color mixing and of extremely high image quality having good luster.

For the sake of comparison, a colored picture image was reproduced by developing the latent images formed in the same manner as mentioned above with the comparative color developers. These colored picture images, however, were found to have been insufficient for their fixation and transferability, and the image surface was also poor in gloss and the color mixing in the transferred image was also inferior.

EXAMPLE 20

The procedure of Example 18, was followed except that Piccolyte S-85 and Piccolyte S-135, respectively, were used in place of YS Resin PX #900 for preparation of a developing liquid. Substantially the same results as in Example 18 could be obtained.

EXAMPLE 21

The procedure of Example 18, was followed except that Piccolastics D-75 (a trademark for polystyrene of Esso Standard Oil Co.) and NG-3 (a trademark for cumarone resin of Nittetsu Kagaku K.K.), respectively, were used in place of Piccoflex 105 for preparation of a developing liquid. Substantially the same results as in Example 18 could be obtained.

EXAMPLE 22

In place of Piccolastics used in Example 19, there were used Pentacite P 423 (a trademark for natural resin modified pentaerythrital resin of Nippon-Reichhold K.K.) Super Beckarcite 2100 (a trademark for phenolic resin of Nipon-Reichhold K.K.), nitrocellulose, ethyl cellulose, UE 750 (a trademark for a copolymer resin of ethylene and vinyl acetate, s.p. 113° C., of Toyo Soda Kogyo K.K.), EEA 6169 (a trademark for a copolymer resin of ethylene and ethyl acrylate, s.p. 64° C. of Nippon Unica K.K.), and Pliolite AC (a trademark for acrylic polymer of Goodyear Tire & Rubber Company), respectively, for the preparation of a developing liquid. Substantially the same results as in Example 19 could be obtained.

I claim:

1. A liquid developer for developing electrostatic latent images consisting essentially of:

(a) an electrically insulating isoparaffinic hydrocarbon carrier liquid having a volumetric resistance of at least $10^9$ ohm-cm and a dielectric constant no greater than 3;

(b) a toner insoluble in said carrier liquid composed of a pigment or dye and a light transmitting thermoplastic resin having a softening point range from 50°-130° C.;

(c) a surface active agent soluble in said carrier liquid in amounts between $10^{-3}$ and 10 gm. per liter of liquid developer selected from the group consisting of lecithin, cephalin, an alkyl alanine containing an alkyl group having 8-20 carbon atoms; a metal salt of naphthenic acid wherein the metal is Ca, Mn, Pb, Zn, Fe, Al or Ni; a fatty acid zirconium salt containing an alkyl group having 2-30 carbon atoms; a metal salt of an alkyl benzene sulfonate containing an alkyl group having 8-20 carbon atoms, a dialkyl sulfosuccinate containing an alkyl group having 8-20 carbon atoms, a dialkyl naphthalene sulfonate containing an alkyl group having 8-20 carbon atoms, a polyoxyethylene sulfate and a dialkyl phosphate containing an alkyl group having 8-20 carbon atoms, wherein the metal is Na, K, Mg, Co, Ba, Al or Zn; and mixtures thereof; and (d) a terpene resin having a repeating unit of the formula:

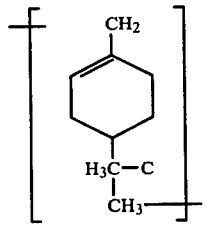

said terpene resin (i) having a softening point of at least 50° C, (ii) being partially soluble in the carrier liquid, and (iii) being present in amounts between 5-50% by weight based on the total weight of the toner, said terpene resin at least partially encapsulating the toner to provide a surface to absorb said surface active agent to promote the charged state of the toner, the remaining portion of said terpene resin tending to dissolve into said carrier liquid to enhance dispersability of said toner.

2. A liquid developer for developing electrostatic latent images consisting essentially of:

(a) an electrically insulating isoparaffinic hydrocarbon carrier liquid having a volumetric resistance of at least $10^9$ ohm-cm and a dielectric constant no greater than 3;

(b) a toner insoluble in said carrier liquid composed of a colored particulate pigment and a light transmitting thermoplastic resin having a softening point range from 50°-130° C. and selected from the group consisting of styrene-butadiene copolymer, polyester and mixtures thereof;

(c) a phospholipid surface active agent soluble in said carrier liquid in amounts between $10^{-3}$ and 10 gm. per liter of liquid developer; and (d) a terpene resin having a repeating unit of the formula:

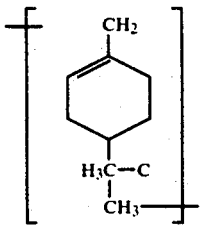

said terpene resin (i) having a softening point of at least 50° C., (ii) being partially soluble in the carrier liquid, and (iii) being present in amounts between 5-50% by weight based on the total weight of the toner; said terpene resin at least partially encapsulating the toner to provide a surface to absorb said surface active agent to promote the charged state of the toner, the remaining portion of said terpene resin tending to dissolve into said carrier liquid to enhance dispersability of said toner.

3. The liquid developer for electrostatic latent images according to claim 1, wherein the softening point of said terpene resin polymer is in the range of between 50° C. and 150° C.

4. The liquid developer for electrostatic latent image as defined in claim 1, wherein said toner is composed of a light transmitting, thermoplastic resin having a softening point range of from 50° to 130° C. and being insoluble in both a coloring matter and a carrier liquid.

5. The liquid developer for electrostatic latent images according to claim 1, wherein said light-transmitting thermoplastic resin is at least one member selected from the group consisting of polyvinyl chloride, polyvinylidene chloride, copolymers of vinyl chloride and vinylidene chloride, chlorinated polypropylene, copolymers of vinyl chloride and vinyl acetate, copolymers of vinyl chloride, vinyl acetate, and maleic anhydride, ethyl cellulose, nitro-cellulose, polyacrylic ester, linseed oil modified alkyd resin, rosin modified alkyd resin, phenol modified alkyd resin, phenolic resin, polyester resin, polyvinyl butyral, poly-isocyanate, polyurethane, polyvinylacetate, polyamide resins, cumarone resin, dammar resin, ketone resin, maleic acid resin, polystyrene, copolymers of styrene, indene, and acrylonitrile, copolymers of styrene and butadiene, phenol modified pentaerythritol ester resin, and celophonium.

* * * * *

UNITED STATES PATENT AND TRADEMARK OFFICE

CERTIFICATE OF CORRECTION

PATENT NO. : 4,259,428

DATED : March 31, 1981

INVENTOR(S) : TERUKUNI TSUNEDA

It is certified that error appears in the above-identified patent and that said Letters Patent is hereby corrected as shown below:

Column 1, line 21, "tone" should read --toner--.
Column 1, line 37, "absorb" should read --adsorb--.
Column 2, line 16, "is" should read --in--.
Column 2, line 30, "known" should read --in the--.
Column 2, line 42, "image, also," should read --image. Also, the--.

Column 4, line 39, "(B-pinone)" should read --(B-pinene)--.

UNITED STATES PATENT AND TRADEMARK OFFICE

CERTIFICATE OF CORRECTION

PATENT NO. : 4,259,428

DATED : March 31, 1981

INVENTOR(S) : TERUKUNI TSUNEDA

It is certified that error appears in the above-identified patent and that said Letters Patent is hereby corrected as shown below:

Column 4, lines 42-61

"

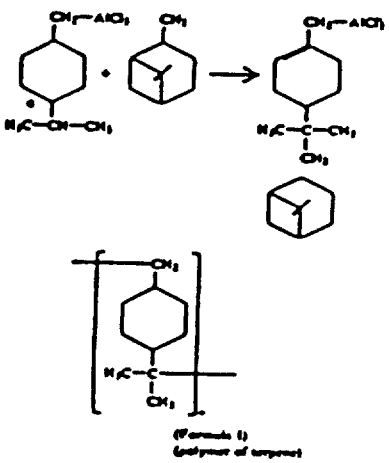

".

should read --

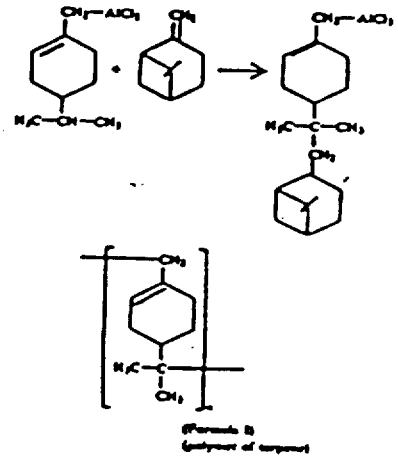

--

UNITED STATES PATENT AND TRADEMARK OFFICE

CERTIFICATE OF CORRECTION

PATENT NO. : 4,259,428

DATED : March 31, 1981

INVENTOR(S) : TERUKUNI TSUNEDA

It is certified that error appears in the above-identified patent and that said Letters Patent is hereby corrected as shown below:

Column 6, line 24, "zircouim" should read --zirconium--.
Column 6, line 27, "sulfo" should read --sulfonates--.
Column 6, line 29, "sulfosccinates" should read --sulfosuccinates--.
Column 7, line 54, "cetone" should read --ketone--.
Column 7, line 58, "collophonium" should read --colophonium--.
Column 7, line 59, "above enumerated" should read -- above-enumerated--.
Column 7, line 60, "have" should read --having--.
Column 8, line 23, "E C.L." should read --E, C.I.--.
Column 8, line 27, "sbyrenebutadiene" should read --styrene-butadiene--.
Column 8, line 37, "An other" should read --Another--.
Column 8, line 44, "soluene" should read --toluene--.
Column 10, line 33, "S100"(first occurrence) should read --S-100--
Column 10, line 46, "the results the same of" should read --the results of the same--.
Column 11, line 32, "results are" should read --results as--.
Column 12, line 62, "New Fast" should read --Neo Fast--.
Column 12, line 62, "C.L." should read --C.I.--.

Column 13, line 55, "C.L." should read --C.I.--.

UNITED STATES PATENT AND TRADEMARK OFFICE

CERTIFICATE OF CORRECTION

PATENT NO. : 4,259,428

DATED : March 31, 1981

INVENTOR(S) : TERUKUNI TSUNEDA

It is certified that error appears in the above-identified patent and that said Letters Patent is hereby corrected as shown below:

Column 16, line 34, "C.L." should read --C.I.--.
Column 16, line 38, "C.L." should read --C.I.--.
Column 16, line 38, "No. 45760" should read --No. 45160--.
Column 16, line 56, "C.L." should read --C.I.--.
Column 16, line 66, "Standrd" should read --Standard--.
Column 17, line 10, "4g" should read --34g--.
Column 17, line 42, "C.L." should read --C.I.--.
Column 17, line 45, "C.L." should read --C.I.--.
Column 17, line 42, "No. 158572" should read --No. 15850--.
Column 18, line 5, "C.L." should read --C.I.--.

Column 19, line 65, "Nipon" should read --Nippon--.

UNITED STATES PATENT AND TRADEMARK OFFICE

CERTIFICATE OF CORRECTION

PATENT NO. : 4,259,428

DATED : March 31, 1981

INVENTOR(S) : Terukuni Tsuneda

It is certified that error appears in the above-identified patent and that said Letters Patent is hereby corrected as shown below:

Column 21, lines 10-20,

"

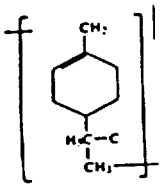

should be

--

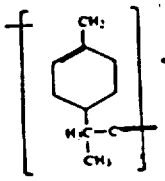

--

Signed and Sealed this

Thirty-first Day of July 1984

[SEAL]

*Attest:*

GERALD J. MOSSINGHOFF

*Attesting Officer*

*Commissioner of Patents and Trademarks*